US006171173B1

(12) United States Patent
Alcala et al.

(10) Patent No.: US 6,171,173 B1
(45) Date of Patent: Jan. 9, 2001

(54) TOY REFRIGERATOR HAVING AN ACTIVITY SURFACE

(75) Inventors: Jose Alcala, Fayetteville, AZ (US); Sofia Dumery; Sun Chul Kim, both of Brooklyn, NY (US); Kimberly Leonard, Washington, DC (US); Andrew Schloss, New York, NY (US)

(73) Assignee: ABC School Supply, Inc., Duluth, GA (US)

( * ) Notice: Under 35 U.S.C. 154(b), the term of this patent shall be extended for 0 days.

(21) Appl. No.: 09/479,004

(22) Filed: Jan. 7, 2000

Related U.S. Application Data

(60) Provisional application No. 60/115,741, filed on Jan. 13, 1999.

(51) Int. Cl.[7] ..... A63H 3/52; A63H 33/30

(52) U.S. Cl. ..... 446/479; 446/73; 446/71; 446/75; 40/600; 312/204; 434/383

(58) Field of Search ..... 446/479, 73, 481, 446/129, 476, 478, 482, 71, 75, 139; 434/383, 128, 156, 159, 160, 171, 172, 175, 408; 312/204, 401, 402, 405, 405.1, 321.5; D21/524, 406; D15/85; 40/600, 621, 649, 312, 611, 320, 727, 725; D19/21, 20

(56) References Cited

U.S. PATENT DOCUMENTS

D. 258,971 * 4/1981 Orenstein et al. ..... 446/479
1,505,843 * 8/1924 Banta ..... 40/611
4,341,034 * 7/1982 Tsui et al. ..... 446/479
4,852,282 * 8/1989 Selman ..... 40/600
4,992,068 * 2/1991 Conrad ..... 446/478
6,053,585 * 4/2000 Osen ..... 312/204
6,065,253 * 5/2000 Ojeda ..... 446/478

OTHER PUBLICATIONS

"Korners For Kids Microwave Oven" 008–54461—p. 95 of ABC School Supply General Catalog—1996.
"Little Helper's Refrigerator" 344–61281—p. 96 of ABC School Supply General Catalog—1996.
"Korners For Kids Toddler Refrigerator" 008–11481—p. 94 of ABC School Supply General Catalog—1998.
"Korners For Kids Microwave Oven" 008–54481—p. 92 of ABC School Supply General Catalog—1998.
"KFK Toddler Refrigerator" 008–11462—p. 52 of ABC School Supply Catalog—1996.
"Colorco Refrigerator" 755–3()62—p. 52 of ABC School Supply Catalog—1996.

* cited by examiner

*Primary Examiner*—Jacob K. Ackun
*Assistant Examiner*—Urszula M. Cegielnik
(74) *Attorney, Agent, or Firm*—Womble, Carlyle Sandridge & Rice

(57) ABSTRACT

The present invention teaches a toy refrigerator with a body and a door that has an activity surface, which is either a metallic surface or a writing surface, such as a whiteboard. The body and the door is made either from plastic material or from wood. The activity surface is used as a space to teach children through use of additional play items such as magnetized alphabets or figures. The activity surface is alternatively used as writing or drawing or posting surface.

5 Claims, 3 Drawing Sheets

TOY REFRIGERATOR HAVING AN ACTIVITY SURFACE

RELATED APPLICATIONS

This application claims the priority of the U.S. provisional application Ser. No. 60/115,741, filed on Jan. 13, 1999.

TECHNICAL FIELD

The present invention is generally related to children's furniture. More particularly, the present invention relates to a toy refrigerator.

SUMMARY OF THE INVENTION

Children like to mimic adults by playing with a mini kitchen, and one of the kitchen appliances that they like to play with is the refrigerator. This specification discloses a construction of a toy refrigerator having a built-in metal surface or other activity surface by which children can mimic the message posting function of their parents' refrigerators.

Briefly described, the present invention comprises a toy refrigerator whose structural cabinet is primarily of wood or plastic material and which presents a magnetic surface or, alternatively, a chalk board, erasable marker surface, corkboard, or other activity surfaces.

The toy refrigerator has the basic appearance of a real refrigerator to stimulate a child's desire to play and to hold the child's interest. In preferred embodiments, the refrigerator has a body defining an interior refrigerator chamber, and a door having recess handles attached to the body through hinges. The door is generally substantially rectangular, of a size and configuration to match the refrigerator body. The door includes front and back sides and top, bottom and lateral faces or sides defining the periphery of the door. The refrigerator body structure is optionally equipped with removable shelves received within the refrigerator chamber. The shelves allow storage of toys/fake food, etc., mimicking the placement of food, etc. in a real refrigerator, and the door can be opened, as would the door on a real refrigerator. The recess handle also can be replaced by any traditional type of handle, as would be understood by those in the art.

A stepped or sunken recess is, in preferred embodiments, generally formed in the door, through which an activity surface, such as a surface formed from a metallic material for application of magnets, is attached and displayed. The sunken recess, alternately, is positioned on the front side or the back side of the door. When it is on the back side, a window typically is formed in the front side of the door as to expose the activity surface to view and use from the front of the door. The activity surface is optionally mounted onto or inserted into the door through a slit or channel located on a top face or either lateral face of the door.

The construction of the activity surface and manner of assembly within the door are designed to minimize the risks of injuries to children who play with the refrigerator. The toy refrigerator is preferably made either from a plastic material or wood, with sharp edges from the activity surface concealed and the comers of the door and the body rounded.

Various objects, features, aspects, and advantages of the present invention will become better understood with reference to the following figures, description and appended claims.

BRIEF DESCRIPTION OF THE DRAWINGS

The invention is better understood by reading the following detailed description of the preferred embodiment in conjunction with the accompanying drawings, wherein.

DETAIL DESCRIPTION

Figure 1:
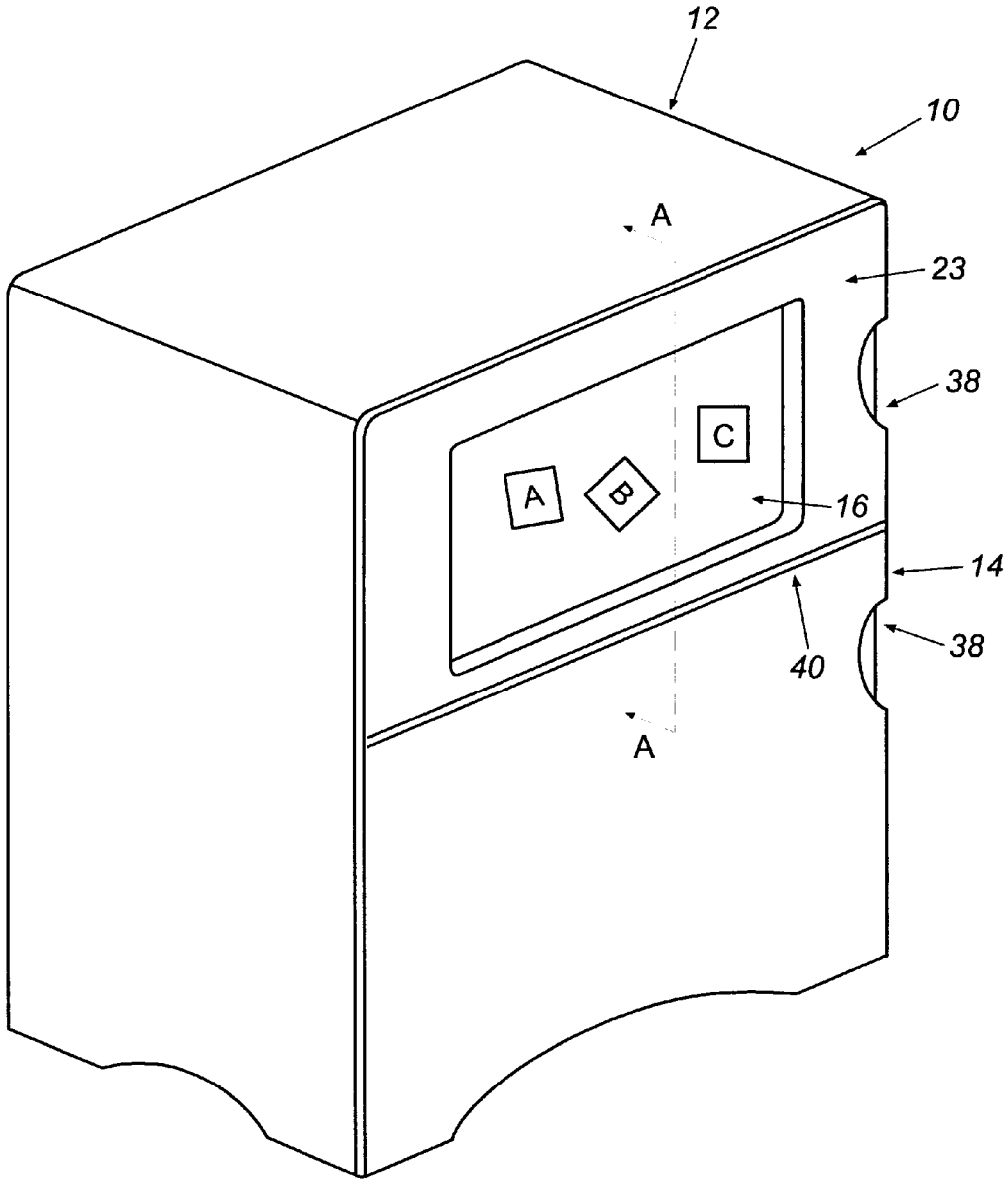
FIG. 1 is a perspective view of the toy refrigerator.

Referring now in more detail to the drawings in which like numerals refer to like parts throughout the several views, FIG. 1 generally illustrates a toy refrigerator 10 in accordance with one preferred embodiment of the present invention. The toy refrigerator 10 generally includes a body 12, a door 14 and an inserted activity surface 16. Both the body 12 and the door 14 generally are substantially rectangular in configuration and are generally of a reduced size as compared to a real, full-size operative refrigerator. The door 14 and body 12 further typically are made from a plastic material from blow molding or injection molding or wood, though other rigid materials are acceptable, with any sharp edges and corners preferably being rounded to minimize the risk of injury.

Figure 2:
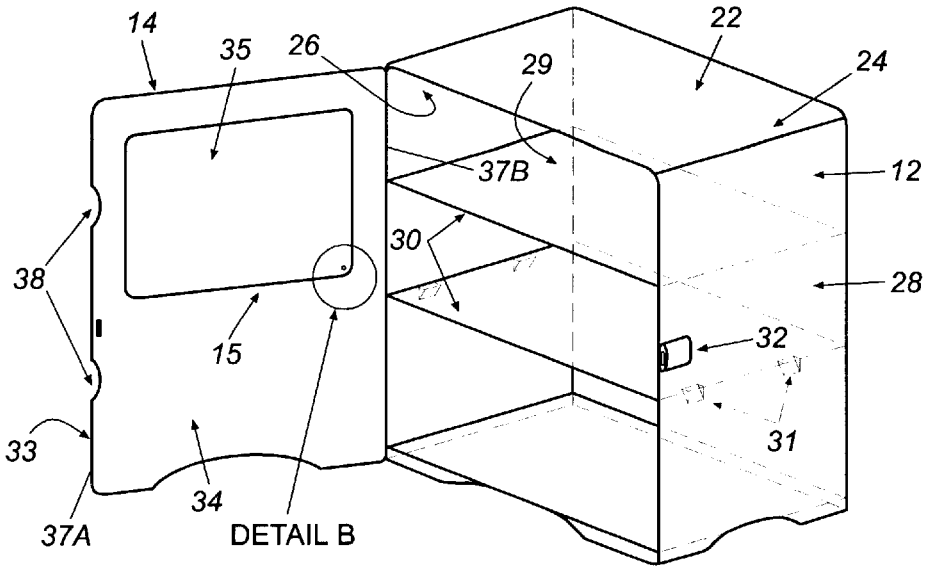
FIG. 2 is a perspective view of the toy refrigerator with its door in the open position.

FIG. 2 depicts the toy refrigerator with its door opened. The body 12 has essentially a box structure having a top panel 22, a back panel 24, a left side panel 26, and a right side panel 28 defining an internal refrigerator chamber 29. A plurality of shelves 30 are, in preferred embodiments, received within the refrigerator chamber 29 for storing toy food, etc., thereon as would be done in a real refrigerator. The shelves 30 are optionally supported within the refrigerator chamber 29 by movable supporting brackets 31 or by multiple fixed supporting brackets. The position of shelves 30 typically are optionally adjustable within the body 12 and the shelves 30 are, alternatively, removable from the body 12.

As indicated in FIG. 2, the door 14 is attached to the body 12 through hinges or other similar means generally mounted internally within the frame of the door 14 and the left panel 26 of the body 12. A latch 32 is provided along the right panel 28 of the body 12, as shown in FIG. 2, for releasably securing the door 14 against the body 12. The latch 32 is optionally a mechanical latch such as a hook and loop fastener, such as Velcro®, or a magnetic latch, that enables the door to be shut and held in a closed positions but requires minimal pressure to release and open the door 14. The door 14 is alternatively attached to the left panel 26 or the right panel 28 of the body 12.

The door 14 includes a front side or facing surface 33 and a back side or facing surface 34, with a sunken recess or a stepped recess 35 (see FIG. 3) formed on its back side 34 for receiving an activity insert 15 which defines an activity surface 16. The door 14 further includes right and left lateral faces or sides 37A and 37B. A recess handle 38 and optionally a groove 40, shown in FIG. 1, are formed in the door 14 on its front side 33 along the right lateral face 37A or thereof. The sunken recess 35 formed in the door 14 with the activity insert 15 attached, is shown in further detail in FIG. 3.

Figure 6:
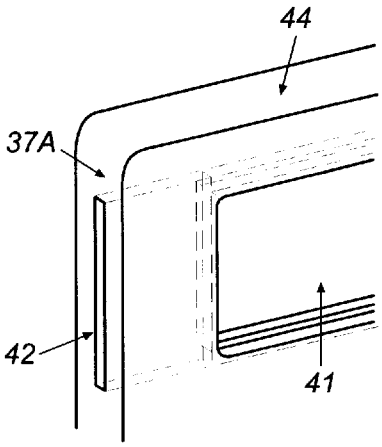
FIG. 6 is a perspective view of an alternate placement of the activity surface within a slit formed along a lateral face of the door.

The sunken recess 35 has an opening 41 that opens towards the front side 33 of the door 14 to enable the activity surface 16 to be seen and accessed from the front side 33 of the door 14. The sunken recess 35 is alternatively located on the front side 33. The size of sunken recess 35 can vary and up to as large as covering almost the entire door 14 and is not limited to what is shown in FIGS. 1 and 2. The activity surface 16 optionally is made of metallic material, or is formed as a writing surface such as a blackboard or whiteboard, and thus serves alternatively as a writing surface or a magnetic bulletin board. As a writing surface, such as a blackboard or a whiteboard, children and adults can write on the activity surface 16 with chalk or dry markers, forming words or pictures thereon, while as a magnetic bulletin board, children can place magnetic letters, figures, etc. on the board to form words or pictures. The activity surface 16 is, in alternate embodiments, a cork-board where messages and children's art works can be attached through thumb nail or other attaching device. Preferably, the activity insert 15 is a solid member comprised of the material of the activity surface 16. However, alternate inserts, such as a laminate member of which the activity surface 16 is one of the outer layers, are acceptable. In the alternate embodiment of FIG. 7, the activity insert 15' is comprised of two or more separate members, such as the front insert member 68 (on which is defined the activity surface 16) and a cover member 70. The activity insert 15, in the preferred embodiments, is attached to the door 14 through the back side 34, or alternatively, as shown in FIG. 6, through a slit 42 formed in the top face 44 or a lateral face 37A or 37B of the door 14.

Figure 3:
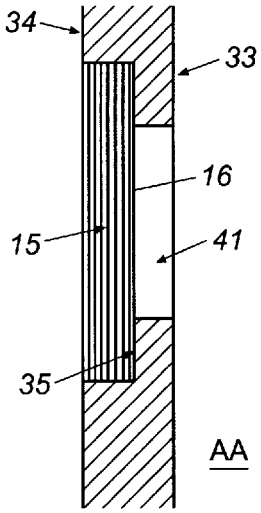
FIG. 3 is a cross section of view taken along lines AA in FIG. 1, showing of a portion of the door and the sunken recess.
Figure 5:
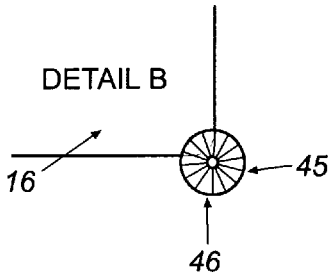
FIG. 5 depicts the detail "B" of FIG. 2 showing an alternate embodiment of the attachment of the activity surface to the door.
Figure 4:
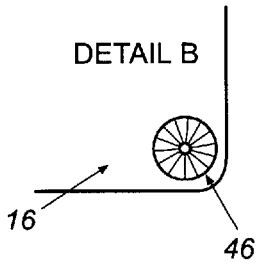
FIG. 4 depicts a detail "B" of FIG. 2 showing an embodiment of the attachment of the activity surface to the door.
Figure 7:
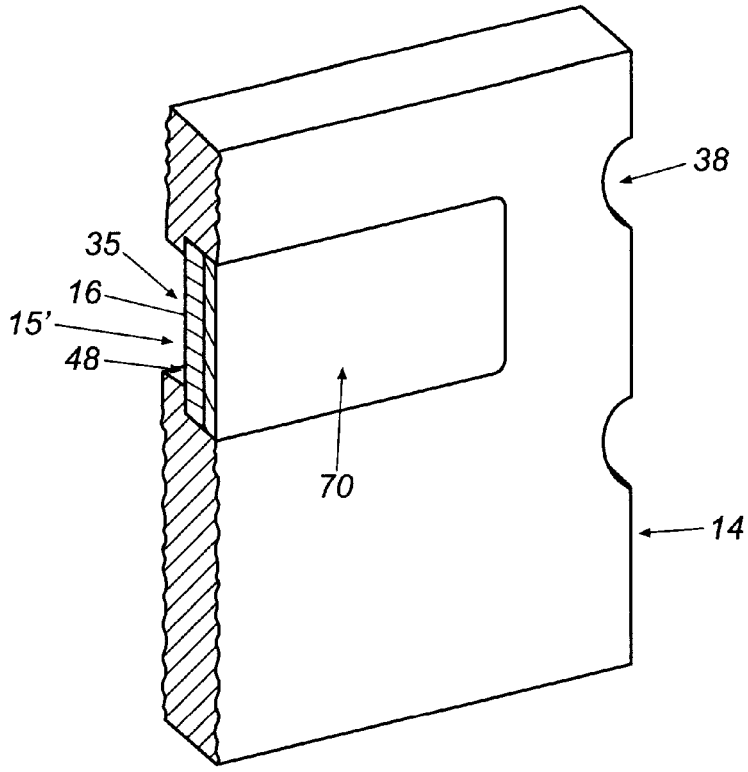
FIG. 7 is a perspective view of a cross section showing use of a cover panel to secure the activity surface.

When the activity insert 15 is attached against the back side 34 of the door 14, it typically is secured through fasteners such as washers 45 and screws 46 or other attaching means such as adhesive means and hook-and-loop fasteners, such as Velcro®. The attachment of the activity insert 15 with screws 46 is generally done with the screws 46 inserted through the activity insert 15 and into the door 14 as shown in FIG. 4 or, alternatively into the door 14 only without going through the activity member as shown in FIG. 5, where the washer 45 and the screw 46 bear against and hold the activity insert 15 against the door 14 as shown in FIG. 7. In the embodiments of FIGS. 3 and 7, the activity insert 15, 15' is of such a thickness to be flush with the entry surface (in the depicted embodiments, the back facing surface 34) of the door 14, to not expose any sharp edges.

The recess handle 38 generally is located on the side of the door 14 that is not hinged. The recess handle 38 allows children to open the door 14 easily. Alternatively, a more traditional type of handle, such as a pull handle or knob, could be employed to open the door 14. The door 14 further has optionally a groove or score line 40 along a centerline thereof for providing the appearance of double front doors.

Figure 8:
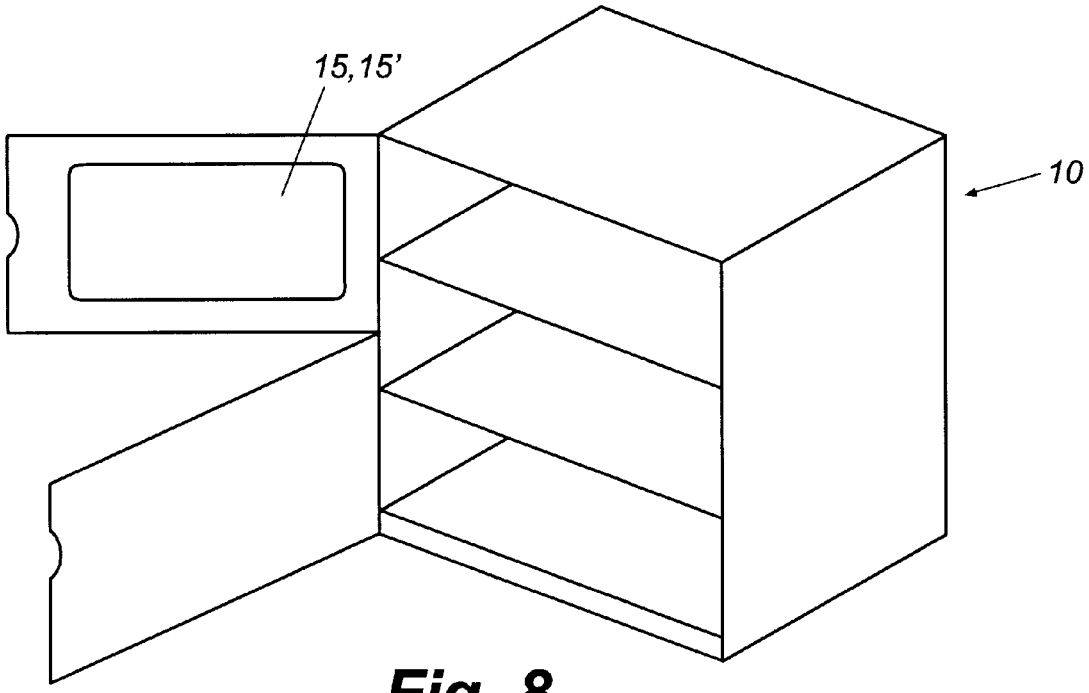
FIG. 8 illustrates a double door configuration.

In an alternative embodiment, the door 14 is formed without the sunken recess 35. Instead, the entire front side 33 is alternatively formed from a writing surface, such as a blackboard or a whiteboard, and/or a magnetic bulletin board. The useful surface for writing or attaching magnetic letters and figures thus is significantly increased, if so desired. In yet another embodiment, the activity surface 16 is alternatively assembled onto one of side panels other than the door. In yet another embodiment, there is more than one activity surface mounted onto different side panels. In yet another embodiment, a double door configuration is used as shown in FIG. 8.

In use, the toy refrigerator 10 presents itself attractively to children as an adult-like appliance and to stimulate children's interest and desire to play with it. This interest is enhanced when other playful things such as magnetized alphabets or animal pictures are incorporated. Children can place these magnetized items onto the metallic activity surface 16 to mimic adults using refrigerators as the family bulletin board and otherwise stimulate their imagination and creativity. The activity surface 16 being built according to the present invention is intended to reduce the possibility of injury to children and is, therefore, intended for children's use.

Although the present invention has been described with reference to certain preferred embodiment thereof, numerous variations, additions, modifications and substitutions also can be made to the present invention. Therefore, the spirit and scope of the appended claims should not be limited to the description of the preferred versions contained herein.

What is claimed is:

1. In a children's toy refrigerator having a body and a door hingedly attached to said body, the improvement comprising:

said door having
- a front side,
- right and left lateral faces,
- a sunken recess formed in said door, and
- an insert received in said sunken recess, said insert including at least a metallic activity surface, and wherein said insert is mounted substantially flush with at least one surface of said door.

2. The toy refrigerator of claim 1, wherein said door includes a recess handle on said right lateral face of said door.

3. The toy refrigerator of claim 1, wherein said toy refrigerator is made from wood.

4. The toy refrigerator of claim 1, wherein said toy refrigerator is made from injection molding plastic material.

5. The toy refrigerator of claim 1, wherein said toy refrigerator is made from blow molding plastic material.

* * * * *

UNITED STATES PATENT AND TRADEMARK OFFICE

CERTIFICATE OF CORRECTION

PATENT NO. : 6,171,173
DATED : January 9, 2001
INVENTOR(S) : Wang et al.

It is certified that error appears in the above-identified patent and that said Letters Patent is hereby corrected as shown below:

Col. 10, Line 17
replace "wherein the an oxide"
with --wherein the oxide--.

Col. 10, line 63
replace "wherein the an oxide"
with --wherein the oxide--.

Col. 10, line 20
replace "borephospholilicate"
with --borophosphosilicate--.

Col. 10, line 66
replace "borephospholilicate"
with --borophosphosilicate--.

Signed and Sealed this

Fifth Day of June, 2001

*Attest:*

*Attesting Officer*

Nicholas P. Godici

NICHOLAS P. GODICI

*Acting Director of the United States Patent and Trademark Office*